US006605899B2

(12) United States Patent
Berlinghof et al.

(10) Patent No.: US 6,605,899 B2
(45) Date of Patent: Aug. 12, 2003

(54) DIELECTRIC BARRIER DISCHARGE LAMP

(75) Inventors: Werner Berlinghof, Herbrechtingen (DE); Rolf Bäuerle, Langenau (DE); Gerhard Döll, Ulm (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/130,753

(22) PCT Filed: Aug. 31, 2001

(86) PCT No.: PCT/DE01/03345

§ 371 (c)(1),
(2), (4) Date: May 23, 2002

(87) PCT Pub. No.: WO02/27747

PCT Pub. Date: Apr. 4, 2002

(65) Prior Publication Data

US 2002/0163306 A1 Nov. 7, 2002

(30) Foreign Application Priority Data

Sep. 29, 2000 (DE) ..... 100 48 410

(51) Int. Cl.[7] ..... H05B 7/00

(52) U.S. Cl. ..... 315/58; 315/59; 313/623; 313/625

(58) Field of Search ..... 315/58, 59; 313/623, 313/625

(56) References Cited

U.S. PATENT DOCUMENTS

| | | | | |
|---|---|---|---|---|
| 5,604,410 A | * | 2/1997 | Vollkommer et al. | 315/246 |
| 6,097,155 A | * | 8/2000 | Vollkommer et al. | 315/58 |

FOREIGN PATENT DOCUMENTS

| | | |
|---|---|---|
| DE | 43 11 197 | 10/1994 |
| DE | 197 18 395 | 10/1998 |
| EP | 0 061 757 | 10/1982 |
| EP | 0 733 266 | 2/1998 |
| EP | 0 848 407 | 6/1998 |
| JP | 62-010836 | 6/1987 |
| JP | 11-339719 | 3/2000 |
| WO | WO 98/49712 | 8/2000 |

* cited by examiner

*Primary Examiner*—David Vu
(74) *Attorney, Agent, or Firm*—Robert F. Clark

(57) ABSTRACT

The discharge tube (1) of a dielectric barrier discharge lamp is closed off in a gas-tight manner with the aid of a disk-like closure element (7) but without the use of joining elements. For this purpose, the discharge tube (1) has a constriction (10), which surrounds the edge of the disk-like closure element (7) in the form of a ring.

11 Claims, 2 Drawing Sheets

DIELECTRIC BARRIER DISCHARGE LAMP

TECHNICAL FIELD

The invention relates to a dielectric barrier discharge lamp in accordance with the preamble of claim 1.

This is a discharge lamp in which either the electrodes of one polarity or all the electrodes, i.e. of both polarities, are separated from the discharge by means of a dielectric layer (known as a one-sided or two-sided dielectric barrier discharge). In the text which follows, electrodes of this type are also referred to as "dielectric electrodes" for short. In operation, it is quite possible that the polarity of the electrodes may also change, i.e. each electrode alternately functions as an anode and a cathode. In this case, however, it is advantageous if all the electrodes have a dielectric barrier. For further details, reference is made to EP 0 733 266 B1, which describes a particularly preferred mode of operation for dielectric barrier discharge lamps.

The abovementioned dielectric layer may be formed by the wall of the discharge vessel itself, if the electrodes are arranged outside the discharge vessel, for example on the outer wall. On the other hand, the dielectric layer may also be produced in the form of an at least partial encapsulation or coating of at least one electrode arranged inside the discharge vessel, which is also referred to as an internal electrode for short in the text which follows. This has the advantage that the thickness of the dielectric layer can be optimized with a view to the discharge properties. However, internal electrodes require gas-tight current lead-throughs. This requires additional manufacturing steps.

Lamps of the generic type are used in particular in appliances for office automation (OA), e.g. color photo copiers and scanners, for signal lighting, e.g. as brake and direction indicator lights in automobiles, for auxiliary lighting, for example the interior lighting of automobiles, and for background lighting of displays, e.g. liquid-crystal displays, as edge type backlights.

These technical application areas require both particularly short start-up phases and also light fluxes which are as far as possible temperature-independent. Therefore, these lamps do not usually contain any mercury. Rather, these lamps are typically filled with noble gas, preferably xenon, or noble gas mixtures. While the lamp is operating, in particular excimers, for example $Xe_2^*$, which emit a molecular band radiation with a maximum at approximately 172 nm, are formed within the discharge vessel. Depending on the application, this VUV radiation is converted into visible light by means of phosphors.

PRIOR ART

The document WO98/49712 has disclosed a tubular barrier discharge lamp with at least one internal electrode in strip form. One end of the tubular discharge vessel of the lamp is closed off in a gas-tight manner by a stopper which is fused to a part of the inner wall of the discharge vessel by means of soldering glass. The strip-like internal electrode is guided outward through the soldering glass as a supply conductor. A drawback is that a layer of soldering glass as a gas-tight joining means is required between the stopper and the vessel wall.

SUMMARY OF THE INVENTION

It is an object of the present invention to avoid the abovementioned drawback and to provide a dielectric barrier discharge lamp in accordance with the preamble of claim 1 which has an improved closure technique which does not involve the use of joining means.

In a lamp having the features of the preamble of claim 1, this object is achieved by the features of the characterizing part of claim 1. Particularly advantageous configurations are given in the dependent claims.

Furthermore, protection is claimed for a process for producing this lamp in accordance with the features of the process claim.

According to the invention, the discharge tube of the dielectric barrier discharge lamp is closed off in a gas-tight manner, at at least one of its two ends, with the aid of a disk-like closure element but without the use of joining means, as a result of the or each of the two closure elements being arranged at the respective end, inside the discharge tube, and being joined in a gas-tight manner, over its entire circumference, directly to the inner wall of the discharge tube. As is explained in more detail below, this gas-tight joining takes place as a result of the inner wall and the edge of the disk-like closure element being heated to the respective softening point. The term "fusing" is also used as a shortened way of describing this operation, although this term is to be understood in a general sense as meaning that the materials of the two elements which are to be joined do not necessarily have to be intimately fused together. It is only essential that a gas-tight join be formed by heating the two elements which are to be joined to the respective softening points and then bringing them into contact with one another, without additional joining means.

Moreover, the discharge tube is constricted along its entire circumference in the region of the fusion, in such a manner that the constriction surrounds the edge of the disk-like closure element in the form of a ring. In this context, the term "disk-like closure element" is to be understood, in a general sense, as meaning that this closure element merely has to be suitable for being pushed into the discharge tube and being able to close off the end of the tube in the manner described. In the most simple case, it is a circular plate. However, other designs are also suitable, provided only that they have a circular circumference, for example a cylindrical stopper or the like.

The process according to the invention for the production of this discharge lamp involves providing the disk-like closure element, the diameter of which is selected to be slightly smaller than the internal diameter of the discharge tube. At an end of the discharge tube which is to be closed off, this disk-like closure element is introduced in such a manner that initially an annular gap remains, typically of a few hundred micrometers, for example approx. 100 $\mu$m to 300 $\mu$m. An appropriate gap width results firstly from the requirement that it should be as easy as possible for the disk-like closure element to be introduced into the discharge tube, and secondly that the gap must also be closed again in a gas-tight manner at the end of the production of the discharge vessel. To this extent, it is advantageous if the gap is not excessively wide, since otherwise the constriction has to be made correspondingly deep. Moreover, it is advantageous for both the disk-like closure element and that end of the discharge tube which is to be closed off to be preheated in advance. Then, the closure element and the discharge tube are heated in the region of the closure element to the softening point. When the softening point is reached, the discharge tube is finally constricted in such a manner that the entire edge of the closure element is joined to the discharge tube wall in a gas-tight manner in the region of the constriction.

For the purpose of constriction, by way of example, a roller made from a material with a high melting point, for example a graphite roller, is used to press the softened part of the wall of the discharge tube onto the edge of the closure element, with the roller rotating with respect to the circumference of the discharge tube. For the typical gap width described above, a radial depth of the constriction of a few tenths of a millimeter, typically in the range from approx. 0.1 mm to 1 mm, preferably between 0.2 mm and 0.8 mm, particularly preferably between 0.4 mm and 0.6 mm, for example 0.5 mm, has proven sufficient.

It is preferable for the same type of glass to be used for the discharge tube and the disk-like closure element. The fact that the coefficients of expansion are consequently identical means that the stresses are lower than when using an additional joining means as in the prior art. In the latter case, the risk of inevitable stresses is correspondingly high on account of the different coefficients of expansion of joining means, for example soldering glass, and the discharge tube, which consists, for example, of soda-lime glass.

The thermal stresses which are usually generated during the fusion can be reduced by subsequent tempering. The glass fusion and subsequent tempering can be carried out relatively quickly, since the components which are to be fused can be heated directly, unlike in the prior art, where firstly the binder has to be expelled from the sintered parts or glass frits have to be partially melted.

Moreover, the glass fusion according to the invention is less expensive, since the additional joining means is no longer required.

In a preferred variant, that side of the disk-like closure element which faces the interior of the discharge vessel is coated with a reflective layer, e.g. $TiO_2$, $Al_2O_3$, or an interference layer. In this way, the light emerging from the end side of the discharge vessel is reflected back, so that the luminance in the edge region is increased, which is extremely desirable on account of the drop in luminance which is otherwise customary toward the lamp ends.

Moreover, it may be advantageous for the disk-like closure element to be provided with an opening and a pump tube which is formed integrally onto this opening. In this way, the lamp can be evacuated and filled with the aid of this pump tube during production. Alternatively, however, it is also possible to dispense with this opening and the pump tube, specifically if the lamp is produced in a chamber which can be evacuated, for example a vacuum furnace.

A preferred embodiment of the dielectric barrier discharge lamp according to the invention uses the internal electrodes which have already been mentioned in the introduction. In this case, at least one electrode is arranged on the inner wall of the discharge tube, and, in the region of the constriction, leads outward in a gas-tight manner through the join between inner wall and closure element. The discharge tube projects slightly beyond the constriction, so as to provide a contact surface for the connection part of the internal electrodes. Although the joining in accordance with the invention causes a certain displacement of the dielectric barrier, and to this extent disruption to the operation of this dielectric internal electrode would be expected, surprisingly it has been found that the local deformation of the dielectric barrier internal electrode has no negative effects on the dielectric barrier discharge. However, a precondition for this is that the constriction be precisely in the region of the disk-like closure element. More precisely, the axial extent of the constriction should be restricted substantially to the axial extent of the disk-like closure element along the inner wall of the discharge tube. The semicircular curvature of the electrode path in the direction toward the discharge tube axis which inevitably occurs in the immediate vicinity of the constriction does cause the sparking distance to be geometrically shortened locally, but it is clear that the electric field in the area which adjoins the fusion is as a result deformed in such a way that the individual discharges described in the abovementioned WO98/49712 are directed away from the disk-like closure element. This increases the effective sparking distance and additionally prevents the individual discharges from being formed primarily along the disk-like closure element, which is undesirable. For further details, reference is made to the exemplary embodiment.

BRIEF DESCRIPTION OF THE DRAWINGS

In the text which follows, the invention is to be explained in more detail with reference to a plurality of exemplary embodiments. In the drawing:

The following FIGS. 1 to 3 are used to illustrate the process for the production of the dielectric barrier discharge lamp according to the invention.

FIG. 1 shows a discharge tube 1 made from soda-lime glass, which at a first end 2 is initially still open, but at the other end 3 has already been closed off by means of butt-fusion 4.

FIGS. 2*a,* 2*b* show the open end 2 of the discharge tube 1 in a diagrammatic longitudinal section and cross section on line AA, respectively. The inner wall of the discharge tube 1 has already been provided with two diametrically arranged linear internal electrodes 5*a,* 5*b* made from silver, which are covered with a glass dielectric barrier 6*a,* 6*b*. In addition, a disk-like closure element 7 is already arranged centrally in the open end 2 of the discharge tube 1. The external diameter of the disk-like closure element 7 is slightly smaller than the internal diameter minus the thickness of the two internal electrodes 5*a,* 5*b,* including their barriers 6*a,* 6*b,* so that a small gap 11 of approx. 100 $\mu$m to 300 $\mu$m remains over the entire circumference. The closure element 7 has a central bore 8, on which a pump tube 9 is integrally formed.

Figure 1:
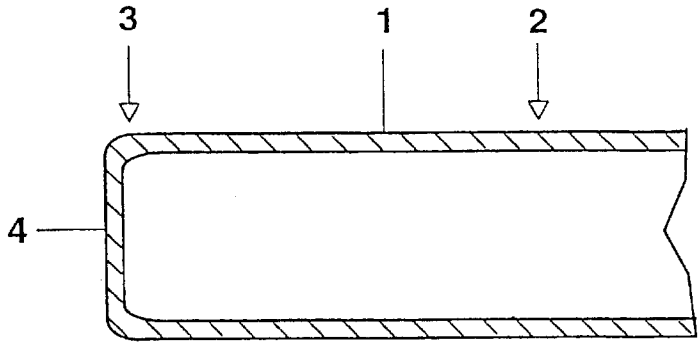
FIG. 1 shows a discharge tube which is closed at one end.
Figure 2A:
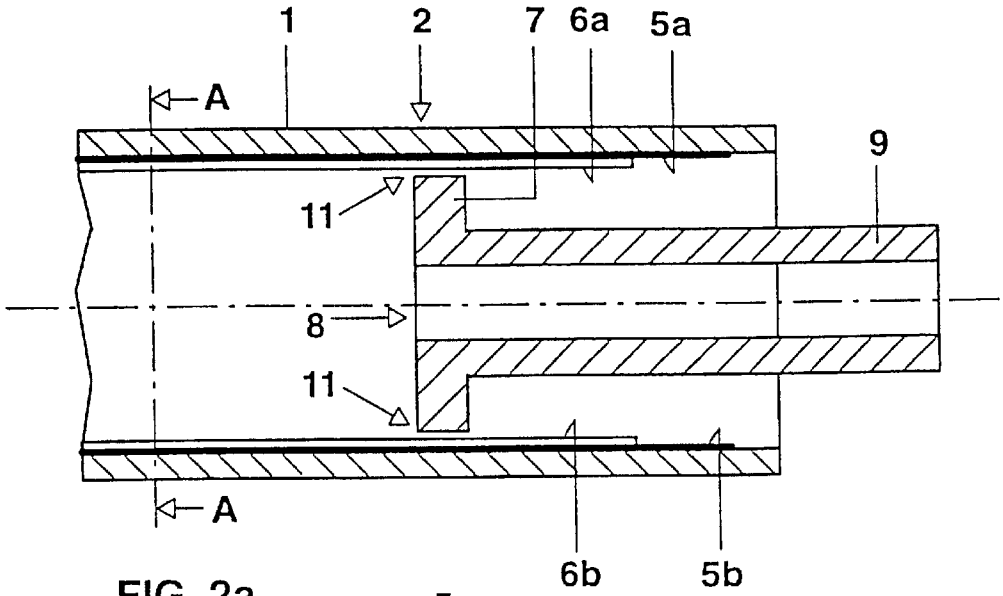
FIG. 2*a* shows a longitudinal section through the unclosed end of the discharge tube from FIG. 1 with an inserted closure element.
Figure 2B:
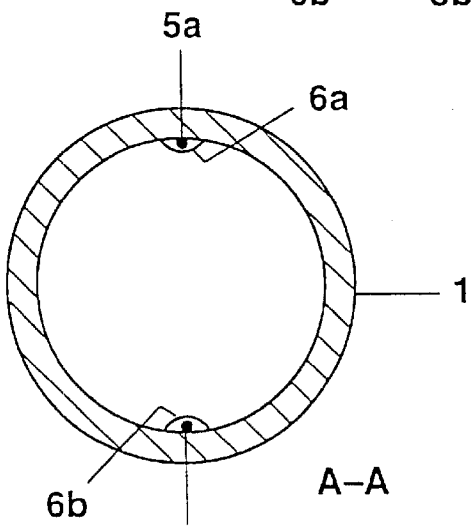
FIG. 2*b* shows a cross section through the discharge tube from FIG. 2*a* on line AA.
Figure 3:
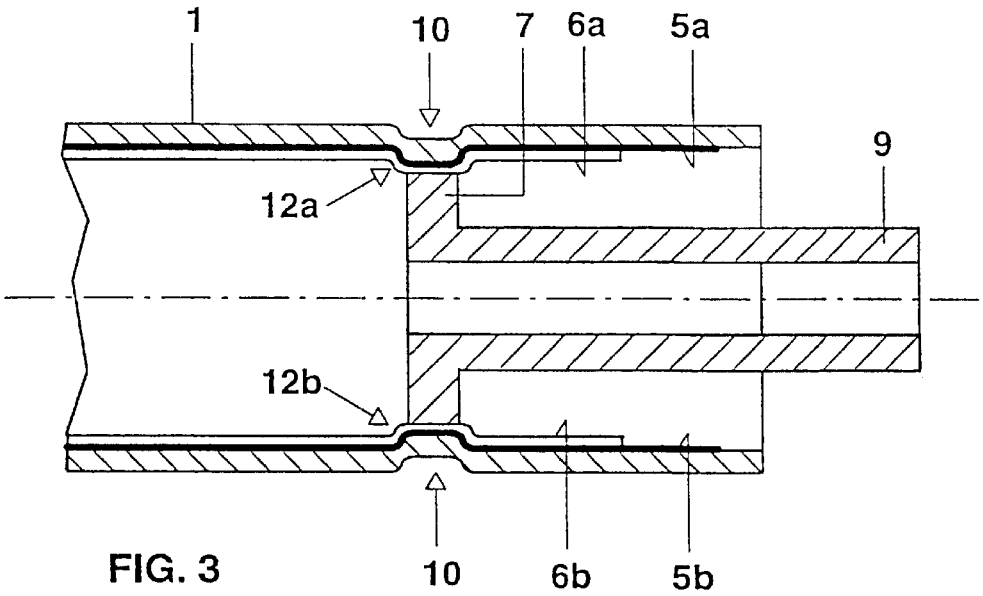
FIG. 3 shows a longitudinal section through the end of the discharge tube from FIG. 1 with fused-in closure element.

In the same way as FIG. 2*a,* FIG. 3 shows the open end 2 of the discharge tube 1 in a diagrammatic longitudinal section view, but in this case after the fusion of the edge of the disk-like closure element 7 to the opposite part of the inner wall of the discharge tube 1. The actual fusion cannot be seen in FIG. 3, since the longitudinal section runs along the electrodes 5*a,* 5*b* or barriers 6*a,* 6*b*. However, the constriction 10 which runs around the edge or, more accurately, the circumferential surface of the disk-like closure element 7 can be seen clearly. The depth of the constriction is approx. 0.5 mm. The slight pinching of the two barriers 6*a,* 6*b* in the region of the constriction 10 and the semicircular curvature 12*a,* 12*b* of the electrodes 5*a,* 5*b* in the region which immediately adjoins the constriction 10 within the discharge space can also be seen.

Figure 4:
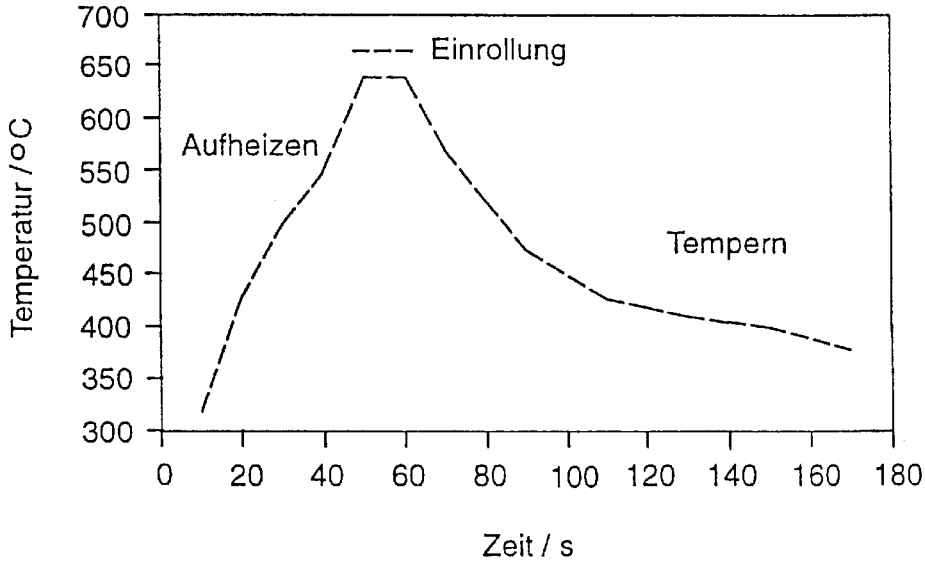
FIG. 4 shows the temperature curve over time inside a furnace during the production of the barrier discharge lamp according to the invention.

FIG. 4 shows the temperature curve over time which is suitable for stress-free fusion within a furnace (not shown) during the production of the lamp according to the invention. After the substantially linear heat-up phase to a temperature of approximately 640° C., which lasts for approximately 50 seconds, the temperature is kept constant for approximately 10 seconds (s). There then follows the tempering, during which the temperature is reduced approximately exponentially to a temperature of approximately 370° C. over a period of approx. 110 s. The fusion between disk-like closure part 7 and the adjoining inner wall of the discharge tube 1 with the aid of local heating to the softening point of the components which are to be fused and the subsequent constriction 10—this operation is also referred to as rolling-in—, as illustrated in FIG. 3, begins shortly before the holding temperature of approx. 640° C. has been reached and typically lasts approx. 10 s.

Figure 5:
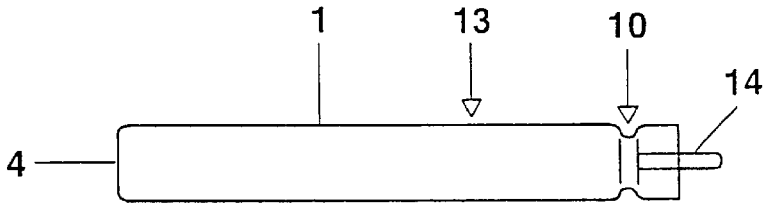
FIG. 5 shows an exemplary embodiment of a finished barrier discharge lamp.

In the text which follows, reference is additionally made to FIG. 5, which illustrates the finished lamp 13. Identical features to those shown in the previous illustrations are provided with identical reference numerals. The two internal electrodes and the associated dielectric barriers cannot be seen in this illustration. After the discharge tube 1 has been filled via the pump tube 9, the latter is melted off to form a pump tip 14. The lamp can then be capped if required.

What is claimed is:

1. A dielectric barrier discharge lamp (13) having a closed tubular discharge vessel (1, 4, 7) and having elongate electrodes (5*a*; 5*b*), the discharge vessel (1, 4, 7) comprising a discharge tube (1) which is closed at both its ends, wherein at least one end of the discharge tube (1) is closed off in a gas-tight manner with the aid of a disk-like closure element (7) but without the use of joining means, as a result of the or each closure element (7) being arranged at the respective end (2) within the discharge tube (1) and being joined in a gas-tight manner, over its entire circumference, directly to the inner wall of the discharge tube (1), the discharge tube (1) being constricted over its entire circumference in the region of the join, in such a manner that the constriction (10) surrounds the edge of the disk-like closure element (7) in the form of a ring.

2. The discharge lamp as claimed in claim 1, in which the axial extent of the constriction (10) is substantially restricted to the axial extent of the disk-like closure element (7) along the inner wall of the discharge tube.

3. The discharge lamp as claimed in claim 1, in which the radial depth of the constriction (10) is in the range from approx. 0.1 mm to 1 mm, preferably between 0.2 mm and 0.8 mm, particularly preferably between 0.4 mm and 0.6 mm.—

4. The discharge lamp as claimed in claim 1, in which at least one electrode (5a; 5b) is arranged on the inner wall of the discharge tube (1) and, in the region of the constriction (10), leads outward, in a gas-tight manner, through the join between inner wall and closure element (7).—

5. The discharge lamp as claimed in claim 1, in which the disk-like closure element (7) has an opening (8), on which a pump tube (9) is integrally formed.

6. The discharge lamp as claimed in claim 1, in which that side of the disk-like closure element which faces the interior of the discharge vessel is coated with a reflective layer.

7. The discharge lamp as claimed in claim 1, in which the discharge tube projects beyond the closure element (7).

8. The discharge lamp as claimed in claim 1, in which the discharge tube (1) and the disk-like closure element (7) consist of the same type of glass.

9. A process for producing the discharge lamp as claimed in claim 1, comprising the following process steps:

providing a disk-like closure element (7), the diameter of which is smaller than the internal diameter of the discharge tube (1), introducing the disk-like closure element (7) at an end (2) of the discharge tube (1) which is to be closed off, in such a manner that an annular gap remains, heating the closure element (7) and the discharge tube (1) in the region of the closure element to the softening point, constricting the discharge tube (1) in such a manner that the edge of the closure element (7) is joined to the inner wall of the discharge tube (1) in a gas-tight manner in the region of the constriction (10).

10. The process as claimed in claim 9, in which, for the purpose of constriction, a roller made from a material with a high melting point presses the softened part of the wall onto the edge of the closure element.

11. The process as claimed in claim 9, in which the disk-like closure element (7) and that end (2) of the discharge tube (1) which is to be closed off are preheated prior to the introduction.

* * * * *